US008171639B2

(12) United States Patent
Jaykins

(10) Patent No.: US 8,171,639 B2
(45) Date of Patent: May 8, 2012

(54) DECORATIVE BRACELET AND METHOD OF FABRICATION

(76) Inventor: Beverly Jaykins, Las Vegas, NV (US)

( * ) Notice: Subject to any disclaimer, the term of this patent is extended or adjusted under 35 U.S.C. 154(b) by 1037 days.

(21) Appl. No.: 12/151,070

(22) Filed: May 2, 2008

(65) Prior Publication Data

US 2009/0272148 A1 Nov. 5, 2009

(51) Int. Cl.
*A44C 5/00* (2006.01)
*A44C 27/00* (2006.01)

(52) U.S. Cl. ..... 29/896.411; 29/896.41; 29/896.4; 63/3.1

(58) Field of Classification Search ..... 29/896.4, 29/896.41, 896.43, 896.411; 63/3.1, 4, 39
See application file for complete search history.

(56) References Cited

U.S. PATENT DOCUMENTS

| | | | | |
|---|---|---|---|---|
| 1,628,278 | A | 5/1927 | Scheuer | |
| 1,735,788 | A * | 11/1929 | Pink | 245/6 |
| 2,135,333 | A * | 11/1938 | Guba | 245/6 |
| 3,708,862 | A | 1/1973 | Powell, Jr. | |
| 3,983,716 | A | 10/1976 | Kuhn | |
| 4,821,532 | A | 4/1989 | Jaques et al. | |
| 5,713,218 | A | 2/1998 | McCabe | |
| 5,806,732 | A | 9/1998 | Hensley | |
| 6,314,969 | B1 | 11/2001 | Lacause | |
| 6,378,334 | B1 | 4/2002 | Hector | |
| 6,477,861 | B1 | 11/2002 | Potlick | |
| 2003/0209033 | A1 * | 11/2003 | Rosenwasser et al. | 63/3 |

OTHER PUBLICATIONS

Martha Stewart—Button Bracelet, http://www.marthastewart.com/portal/site/mslo/menuitem, 1 page, dated, May 16, 2007.

JHB—Button Jewelry, http://www.jhbinternational.snapmonkey.net/page/page, 1 page, May 16, 2007.

eBay: McCalls Button Bauble Craft Jewelry Leaflet, http://cgi.ebay.com/McCalls-Button-Bauble-Craft-Jewelry-Leaflet, 1 page, dated May 23, 2007.

The Beadery Craft Products®, SS0622 © 2003, 2006 G.P.C., www.thebeadery.com, 7 pages.

Hemp Bracelets http://us.st11.yimg.com/us.st.yimg.com, 1 page, May 16, 2007.

Friendship Bracelets http://us.st11.yimg.com/us.st.yimg.com, 1 page, May 16, 2007.

http://www.crafts4everyone.com/images/stores/project/chinese_knotting/cord_braceletwithchineseknots.jpg 1 page, May 16,2007.

Happy Beads, http://images.etoys.com/g/toys/hires, 1 page, May 29, 2007.

http://i4.ebayimg.com, 1 page, May 16, 2007.

Beads, http://static.zoovy.com/img/stewarttoys, 1 page, May 16, 2007. http://a1516.g.akamai.net/f/1516/9947/2h/www.hearthsong.com. 1 page, May 16, 2007.

* cited by examiner

*Primary Examiner* — Alexander P Taousakis
(74) *Attorney, Agent, or Firm* — Lightbulb IP, LLC

(57) ABSTRACT

A decorative article such as a bracelet is formed from one or more elastomeric cords and one or more braiding cords. Generally, the elastomeric cords provide a structure around which one or more braiding cords may by arranged, and upon which one or more decorative elements may be threaded. The elastomeric cords allow decorative elements, such as buttons, to be secured to the top surface of a decorative bracelet. In addition, the elastomeric cords allow the bracelet to have a more customized fit and increased durability. The braiding cords are woven around the elastomeric cords, such as in knots. A clasp may be formed from the elastomeric cords. The clasp may accept one or more decorative elements to secure the bracelet in a loop configuration.

8 Claims, 5 Drawing Sheets

DECORATIVE BRACELET AND METHOD OF FABRICATION

BACKGROUND OF THE INVENTION

1. Field of the Invention

The invention relates to bracelets and similar decorative objects fabricated by weaving or knotting a plurality of cords.

2. Related Art

Various objects are used as decorations or to adorn the body. In some instances, these articles are formed by weaving or knotting a plurality of cords together to form a body or structure of the article. For example, fabric or textile cord or string may be woven to form a decorative article.

Decorative elements may also be interwoven into this structure. Traditional methods for fabricating such articles involve knotting or weaving around a decorative element to secure the element to the article. In this method, the knotting or weaving surrounds the decorative element, which is not desirable for durability and aesthetic reasons. Furthermore, some types of decorative elements cannot be secured to a textile article using traditional methods.

Traditional methods have other drawbacks as well. This is due to the fact that decorative elements must generally be secured by weaving or knotting around the elements. The required weaves or knotting surround each decorative element which distracts from the decorative elements.

Thus, what is desired and disclosed herein is a decorative bracelet and method of fabrication without the limitations and drawbacks of the traditional articles and methods.

SUMMARY OF THE INVENTION

In general, the invention comprises a decorative article and a method of forming such an article. The article may be formed for various purposes or applications, such as for use as a bracelet.

In one embodiment, the decorative article, such as a decorative bracelet, comprises one or more elastomeric cords, braiding cords, decorative elements, and clasps. In one or more embodiments, the elastomeric cords extend from a first end to a second end of the decorative bracelet. The braiding cords have one or more knots therein, the one or more knots generally tied around at least one of the one or more elastomeric cords. The one or more decorative elements may be threaded on at least one of the one or more elastomeric cords and secured by the one or more knots. The one or more clasps may be configured to accept at least one of the one or more decorative elements. In one or more embodiments, the one or more clasps comprise at least two knots and parallel portions of the one or more elastomeric cords there between.

In some embodiments, the decorative bracelet further comprises a fuse bead at its second end. In general, the fuse bead is configured to accept a portion of the one or more elastomeric cords, a portion of the one or more braiding cords, and a quantity of adhesive. The fuse bead and the quantity of adhesive may be used to secure the one or more elastomeric cords and the one or more braiding cords.

The decorative elements may be various objects. In one or more embodiments, the decorative elements are one or more buttons, each of the one or more buttons having either one or more holes or a shank with an opening. The one or more holes or the shank with an opening may be threaded on at least one of the one or more elastomeric cords and secured by the one or more knots.

The first end of the decorative bracelet may have various configurations. For example, the decorative bracelet's elastomeric cords and braiding cords may be threaded through at least one of the one or more decorative elements at the first end of the bracelet. At its second end, the decorative bracelet may have one of the one or more clasps.

In some embodiments, rather than being multiple cords, the one or more elastomeric cords are substantially equal halves of a single elastomeric cord, and the one or more braiding cords are substantially equal halves of a single braiding cord. In addition, the one or more elastomeric cords and the one or more braiding cords may be formed from the same material.

It is noted that the invention herein may also be a textile article or may be used to form a textile article. A textile article according to the invention may comprise a first end and a second end and one or more elastomeric cords, braiding cords, and decorative elements. Similar to above, the elastomeric cords may extend from the first end to the second end of the textile article, and the braiding cords may have one or more knots therein. In addition, the one or more knots may be tied around at least one of the one or more elastomeric cords, and the one or more decorative elements may be threaded on at least one of the one or more elastomeric cords and secured by the one or more knots.

At its first end, the one or more elastomeric cords and the one or more braiding cords of the textile article may be secured to one or more decorative elements. The one or more elastomeric cords may also be secured to the one or more braiding cords at the first end of the textile article.

In some embodiments, the textile article may include one or more clasps configured to accept at least one of the one or more decorative elements. Generally, such a clasp comprises at least two knots and parallel portions of the one or more elastomeric cords there between.

Similar to the above, rather than being multiple cords, the one or more elastomeric cords may be substantially equal halves of a single elastomeric cord, and the one or more braiding cords may be substantially equal halves of a single braiding cord.

One embodiment of the invention is a method of fabricating a decorative article, such as a decorative bracelet. Generally, the method of fabricating a decorative bracelet comprises securing one or more elastomeric cords and one or more braiding cords at a first end of the decorative bracelet, tying one or more knots with the one or more braiding cords, the one or more knots tied around the one or more elastomeric cords, threading the one or more decorative elements onto at least one of the one or more elastomeric cords, and securing the one or more elastomeric cords and the one or more braiding cords at a second end of the decorative bracelet. In this embodiment of the method, the decorative elements are secured on the top surface of the decorative bracelet by at least one of the one or more elastomeric cords and at least two of the one or more knots.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

FIG. 3A illustrates an embodiment of a decorative element with one or more cords threaded there through.

FIG. 3B illustrates another embodiment of a decorative element with one or more cords threaded there through.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Disclosed herein is a decorative article and a method for fabricating the same. In a preferred embodiment, the decorative article is configured for use as a bracelet, and as such is referred to herein primarily as a bracelet for ease of reference. However, the descriptions and methods herein may apply to other articles such as, but not limited to anklets, rings, belts, suspenders, necklaces, coasters, jewelry, head bands, hair ties, bookmarks, and decorations or art. It is contemplated that various planar, rectangular, circular, or other shaped articles may be formed according to the invention herein. Furthermore, it is contemplated that two or more individual articles formed according to the invention herein may be combined to form other articles, including 3-dimentional objects, shapes or forms, if desired. For example, four planar rectangular articles may be joined along their widths to form a generally square tube structure. Such 3-dimentional configurations would include the advantages of the invention herein and may be desirable as decorations or artwork.

The decorative article has numerous advantages over traditional articles and methods. As will be described further below, in one or more embodiments, the decorative article includes one or more elastomeric cords running along its length. The elastomeric cords allow the decorative article to have a more customized fit and improved durability, while also allowing a wide range of decorative elements to be secured therein and reducing or eliminating the aesthetically distracting weaving required to secure a decorative element as in traditional methods. The use of elastomeric cords also provides the further advantage of allowing decorative elements to be secured from a back or underside so that a cleaner and more desirable appearance may be achieved. In traditional methods, decorative elements are secured by weaving, knotting, or tying around the decorative element, which distracts from the decorative element and/or obscures the element.

Figure 1:
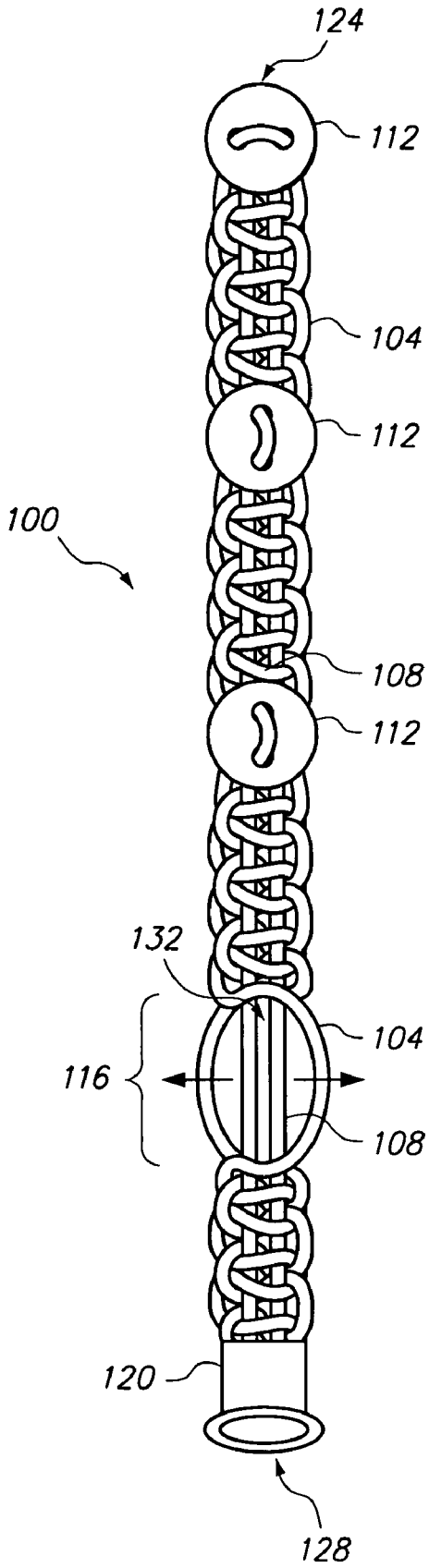
FIG. 1 illustrates an embodiment of a decorative bracelet.

One embodiment of a decorative article will now be described with regard to the figures. FIG. 1 illustrates an example embodiment of a decorative bracelet 100 having a plurality of decorative elements 112. The decorative bracelet 100 has a first end 124 and a second end 128 with one or more braiding cords 104, elastomeric cords 108, and decorative elements 112 there between. Also, one or more clasps 116 may be located between the first end 124 and the second end 128. One or more fuse beads 120 or other structures may be used to secure the decorative bracelet 100 at its second end 128.

In one or more embodiments, the decorative bracelet 100 comprises one or more braiding cords 104 and elastomeric cords 108. The braiding cords 104 may be weaving, macrame, or other cords and may comprise a wide variety of materials now known and later developed, such as but not limited to, cotton, plastic, nylon, polyester, wax cotton, cotton cable cord, leather, wool, bamboo, and hemp, and weaves thereof. Of course, any material that may be woven or knotted as described herein may be used. The braiding cords 104 may be of various diameters, however, it is contemplated that braiding cords of similar diameter will generally be used in a single decorative bracelet 100. A braiding cord 104 may be a single color or multiple colors, and, if more than one braiding cord is used, the braiding cords may be different colors or different arrangements of colors, as desired. The braiding cords 104 may be partially or completely transparent, semi-transparent, or opaque.

The elastomeric or elastic cords 108 preferably comprise a cord or material which has a reasonable degree of elasticity, preferably along its length (and preferably allowing the cord to stretch and contract repeatedly). Such as cord might comprise various elastic or elastomeric materials now known or later developed such as but not limited to PVC and other plastic filaments or cords, natural and synthetic rubber filaments or cords, and various polymeric elements. In one embodiment, the elastomeric cord may comprise a single material or weaves of material. In one or more embodiments, the elastomeric cords 108 may be fishing line, monofilament cord, hollow tubing, or various combinations thereof.

Like the braiding cords 104, the elastomeric cords 108 may be of various diameters. The diameter of the elastomeric cords 108 may be selected based upon the decorative elements 112 and braiding cords 104 to be used in a decorative bracelet 100. For example, some decorative elements 112 may have smaller securing holes or structures than others and require a thinner diameter elastomeric cord 108. The diameter of braiding cords 104 may be selected for similar reasons as well as for aesthetic considerations.

Generally, the elastomeric cords 108 are used herein to support and secure various elements of the decorative bracelet 100. In one or more embodiments, the elastomeric cords 108 provide an elastic, resilient, or stretchable structure which may support the braiding cords 104. In this manner, the decorative bracelet 100 can have a customized fit in that it may stretch or flex to fit various applications. The decorative bracelet 100 may also be stretched to place it as desired and subsequently shrink to fit. For example, the decorative bracelet may be stretched to fit around a users hand and then shrink to better fit around the user's wrist. Of course, not all embodiments will be configured to stretch and thus the type of elastomeric cords 108 used in the decorative bracelet 100 can differ depending on the qualities desired.

Thus, it is contemplated that the elastomeric cords 108 may also be any cord that is of suitable durability, flexibility, or both, such as but not limited to the materials described herein with respect to the braiding cords 104 and including metal wire. It is noted that metal wire has the advantage of retaining its shape as it is bent and that this may be advantageous in certain embodiments of the invention herein. For example, it may be desirable for earrings or decorations to retain a user desired shape.

Though, in one or more embodiments, a large portion of the elastomeric cords 108 are not visible once the decorative bracelet 100 is complete, it is contemplated that the elastomeric cords 108 may be one or more colors, transparent, semi-transparent, or opaque as desired. It is noted that the figures generally illustrate embodiments where the elastomeric cords 108 are visible through the arrangement of the braiding cords 104 to better show the elastomeric cords 108 as used in the decorative bracelet 100.

There may be embodiments where the elastomeric cords 108 are visible, as illustrated in the figures. However, the elastomeric cords 108 may be hidden by the braiding cords 104 in some embodiments. The amount an elastomeric cord 108 is visible may vary depending on aesthetic or structural concerns. In one or more embodiments, the amount the elastomeric cords 108 is visible may be decreased by tightening the arrangement of the braiding cords 104 as described further below. A loosened arrangement or open weave of the braiding cords 104 will allow more of the elastomeric cords 108 to be visible. The amount the elastomeric cords 108 are visible may vary, as desired, along the length of the decorative bracelet 100 such as by tightening or loosening the arrangement of the braiding cords 104.

It is noted that those knowledgeable in the art will recognize that though referred to in plural, the term elastomeric cords 108 may refer to a single elastomeric cord such as in the case where the elastomeric cords are two halves (or other sized portions) of the same elastomeric cord. For example, in the embodiment of FIG. 1, the elastomeric cords 108 at the clasp 116 originate from a single elastomeric cord at the decorative bracelet's 100 first end 124. Similarly, the term braiding cords may refer to a single braiding cord such as in the case the braiding cords are two halves (or other sized portions) of the same braiding cord. Of course, in other embodiments, more than two elastomeric cords 108 may be used.

One or more clasps 116 may be formed along the length of the decorative bracelet 100 as well. In one or more embodiments, a clasp 116 comprises elastomeric cords 108 arranged in generally the same direction. For example, as shown in FIG. 1, the elastomeric cords 108 of the clasp 116 are generally parallel. The use of elastomeric cords 108 in forming a clasp 116 is advantageous because the elastomeric cords are generally more durable than the braiding cords 104 in one or more embodiments. This is because, as described above, the elastomeric cords may be formed from more durable materials. In a preferred embodiment, the arrangement of the elastomeric cords 108 forming the clasp 116 comprises elastomeric cords 108 which are located close to one another.

The elastomeric cords 108 at the clasp 116 form an opening 132 (either because the cords are spaced apart or can be separated) which may accept a fastener. The fastener may be a decorative element 112 in some embodiments, or may be a planar, spherical or other object that is small enough to fit into or through the opening 132 while being large enough to generally keep from falling out or back through the opening. The fastener may be shaped to fit into but not accidentally fall out of the opening 132 as well, in some embodiments. For example, a button shaped fastener can be inserted into the opening 132 by orienting its thinner profile to the opening. The thicker profile of the button shaped fastener may then be used to secure the fastener once it is in or through the opening 132.

It is noted that the elastomeric cords 108 forming the opening 132 may stretch in some embodiments. Thus, fitting the fastener into or through the opening 132 may occur by stretching the opening 132. In these embodiments, the opening 132 may be smaller than other embodiments, smaller than its fastener, or both, because the opening may stretch to accept the fastener.

In one or more embodiments, the clasp 116 allows the decorative bracelet 100 to form a closed loop. This loop may be formed by bending, rolling, or otherwise moving the decorative bracelet 100 such that its fastener may be inserted in or though the clasp 116. As stated, the fastener may be one or more of the decorative elements 112 and thus different size loops may be formed if desired. For example, a decorative element 112 near the middle of the decorative bracelet 100 may be used as the fastener rather than a decorative element at the first end 124 of the decorative bracelet. In addition, the clasp 116 and its one or more fasteners may be configured to allow either or both ends of the decorative bracelet 100 to dangle freely. For example, the clasp 116 and fastener may be located at either or both ends of the decorative bracelet 100, or be located inwardly there from. When a clasp 116 is located inwardly of the ends of the decorative bracelet 100, a portion of each end of the decorative bracelet 100 may hang freely, as may be desired for aesthetic reasons. It is also possible for the decorative bracelet 100 to include more than one clasp 116, such as two or more thereof.

It is contemplated that in some embodiments, a clasp 116 as described herein is will not be necessary. For example, where the invention does not need to be formed into a loop, such as if used as artwork, a clasp 116 will not be necessary. In addition, the clasp 116 will not be necessary because other ways of securing the decorative bracelet 100 into a loop may be used. For example, the decorative bracelet 100 may be tied or sewn into a loop configuration. Also, the decorative bracelet 100 may have one or more clips, ties, magnets, pins, clasps, alligator clips, or metal fittings to secure the decorative bracelet in a loop configuration.

In one or more embodiments a fuse bead 120 is at the second end 128 of the decorative bracelet 100. Generally, the fuse bead 120 secures an end of the braiding cords 104, elastomeric cords 108, or both. As shown in FIG. 1, the fuse bead 120 may be a hollow circular bead. In this embodiment, the elastomeric cords 108 and braiding cords 104 are inserted into the opening of the fuse bead 120 and secured with adhesive, such as hot melt glue. Of course, the fuse bead 120 may be any hollow structure such as tubing, and other adhesives may be used as well. It is noted that, a fuse bead 120 may not be used in all embodiments. The structure which secures the ends of the cords might also comprise an element which is compressed onto or around the cords, or be a structure to which the cords may be tied or otherwise secured. In one embodiment, the braiding cords 104, elastomeric cords 108, or both, may be tied in a knot or secured by one or more clips, clamps, metal fittings, ties, adhesives, or a combination thereof. It is contemplated that a fuse bead 120 may be used at the first end of the decorative bracelet 100 as well.

Figure 2A:
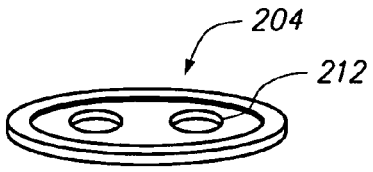
FIG. 2A illustrates an embodiment of a decorative element.
Figure 2B:
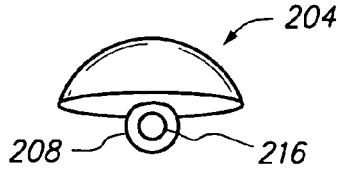
FIG. 2B illustrates another embodiment of a decorative element.

At equal distances or other distances as desired, one or more decorative elements 112 may be secured along the length of the decorative bracelet 100. FIGS. 2A-2B show example embodiments of decorative elements 112. FIG. 2A illustrates a button 204 having holes 212 to allow one or more cords, such as the elastomeric cords of the invention, to be passed or threaded therethrough. As illustrated, the button 204 has two holes 212, however, it is contemplated that buttons 204 having more than two holes may be used and that the placement of the holes may be along a line, in a rectangular or square shape, or in any other configuration as desired. The buttons 204 may also be configured in or have various shapes, colors, and designs.

FIG. 2B illustrates a button 204 with a shank 208 having an opening 216 to allow one or more cords to be threaded there through. It is contemplated that buttons 204 with more than one shank 208 may be used. In addition, buttons 204 with one or more shanks 208 may be configured in or have various shapes, colors, and designs. It is noted that because the shank 208 extends outward from the rest of the button 204, a wide variety of 3-dimentional or planar shapes may be used to for the button. For example, the button 204 may comprise a figurine, miniature, prefabricated bow, or the like having one or more shanks 208.

The decorative elements 112 do not have to be buttons 204 in all embodiments. A combination of buttons 204 and other decorative elements 112 may be used in one or more embodiments. It is contemplated that any decorative element 112 having one or more holes or openings, through which one or more cords of the invention may be threaded, may be used. For example, a safety pin may be used as a decorative element 112 because one or more cords may be thread through the small holes created by the structure of the safety pin.

In addition, decorative elements 112 may be tied or otherwise secured around one or more cords of the decorative bracelet. For example, a bow made of ribbon or other material may have a portion tied around one or more elastomeric cords and thus be attached to the decorative bracelet. Of course other decorative elements 112 other than bows may be tied or secured around the one or more elastomeric cords as well.

It is contemplated that traditional knotting, braiding, crocheting, or weaving methods may be incorporated into at least a portion of the invention. Thus, decorative elements 112 that do not necessarily have one or more holes for the elastomeric cords 108 of the invention may also be used. In one embodiment, the decorative elements 112 might comprise tubular members through which one or more of the cords might pass, or other objects or elements which are otherwise connected to one or more of the cords.

The decorative bracelet 100 is generally formed by a series of knots from the first end 124 of the decorative bracelet 100 and continuing to the second end 128 of the bracelet. Though the decorative bracelet 100 is generally described herein as formed by a series of knots or knotting, such as those in macrame techniques, it is contemplated that the decorative bracelet 100 may be formed by other textile making techniques and structures such as but not limited to those of knitting, weaving, braiding, and crocheting.

The method of fabrication will now be described with regard to FIGS. 3A-10B. It is noted that though the method is generally described with the decorative elements being buttons 204, any decorative element, including but not limited to those described above, may be used.

Figure 3A:
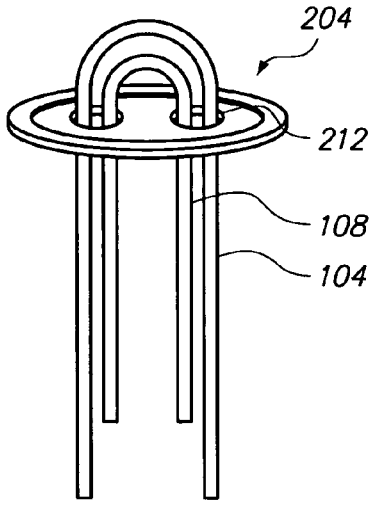
Figure 3B:
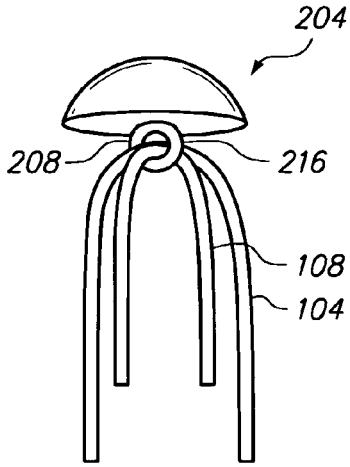

In one embodiment, to start the method of fabrication, a braiding cord 104 and an elastomeric cord 108 are threaded or secured to a decorative element. FIG. 3A shows braiding cord 104 and elastomeric cord 108 threaded through the holes 212 of a button 204 to begin the method of fabrication at the first end of the decorative bracelet. FIG. 3B shows an alternative embodiment where the braiding cord 104 and the elastomeric cord 108 are used with a button 204 having a shank 208. In this embodiment, the cords are threaded through the opening 216 of the shank.

It is contemplated that any method of securing the elastomeric cords 108 and the braiding cords 104 at the first end of the decorative bracelet may be used. For example, the cords may be tied, adhered, or otherwise attached to a decorative element to start the method of fabrication at the first end of the decorative bracelet. Also, the cords may be tied or otherwise attached together to start the method without use of a decorative element. A fuse bead, as described with regard to the second end of the bracelet, may also be used at the first end of the decorative bracelet to start the method.

As shown in FIGS. 3A and 3B, in one embodiment, the cords are looped through the decorative element so that free ends of the cords are generally equidistant (or a length of the cords is generally equal from) the decorative element. In one or more embodiments, the elastomeric cords 108 may be used to secure decorative elements and may be shorter than the braiding cords 104. The braiding cords 104 may be longer than the elastomeric cords 108 because the braiding cords are braided along the length of the decorative bracelet and this braiding requires additional length in order for the braiding cords to reach from the first end to the second end of the decorative bracelet.

Figure 4A:
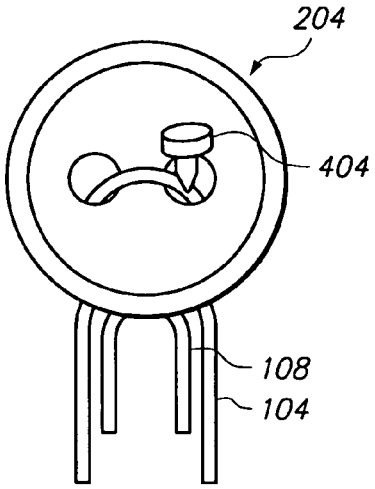
FIG. 4A illustrates an embodiment of a decorative element and one or more cords threaded secured by a pin.
Figure 4B:
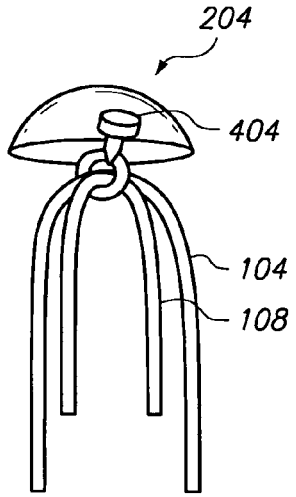
FIG. 4B illustrates another embodiment of a decorative element and one or more cords threaded secured by a pin.

Next, the relative position of the button 204, elastomeric cord 108, and braiding cord 104 may be maintained during the following portions of the method of fabrication. This may be accomplished in various ways. FIGS. 4A and 4B, illustrate the button 204 and cords held by a push pin. The button 204 and cords are held in relative position by inserting the push pin through a hole 212 or opening 216 of a button 204 and into a board, such as cork board. Of course nails, screws, adhesive such as tape, and other pins in addition to various clamps or clips may be used to secure the button 204 and cords.

One or more knots then may be formed along the length of the decorative bracelet. The formation of one or more knots will be described according to an embodiment of the invention. However, it is contemplated that other methods, such as but not limited to macrame, knitting, weaving, braiding, and crocheting techniques now known and later developed, may be used to form one or more knots of the decorative bracelet. In a preferred embodiment, the knots or other weaves of the braiding cords (or cord) are formed around or about at least one or more portions of the elastic cords.

Figure 5:
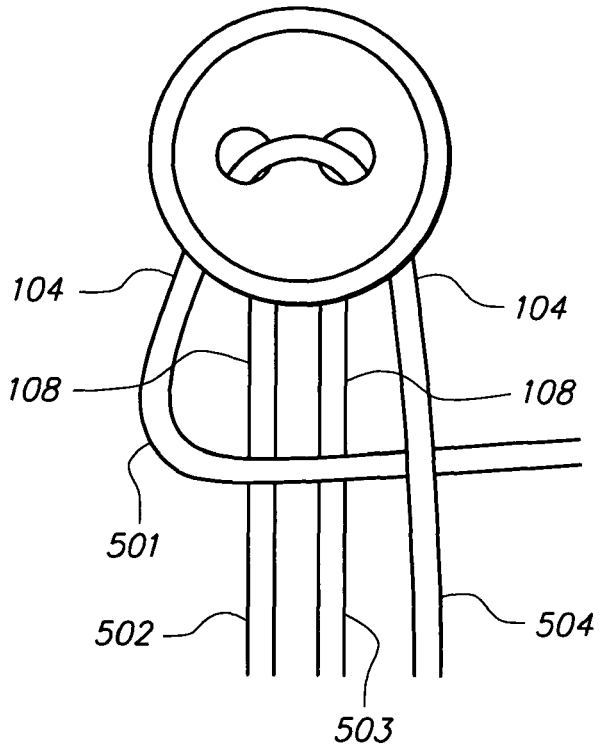
FIGS. 5-8 illustrates a step of tying or forming a knot according to an embodiment of the invention.

As illustrated in FIG. 5, in one preferred embodiment, the cords are arranged so that a first braiding cord 501 is the far left cord, and a second braiding cord 504 is the far right cord (it being appreciated that in one embodiment, these two cords are actually portions of the same cord). In addition, the first elastomeric cord 502 and the second elastomeric cord 503 are arranged in the middle with the first elastomeric cord being on the left (again, it being appreciated that in one embodiment, these two cords are actually portions of the same cord). The first braiding cord 501 is preferably bent into an L shape such that the first braiding cord 501 is positioned over both elastomeric cords 108 and under the second braiding cord 504. Of course, this step of arranging the first braiding cord 501 may be accomplished in various ways (including by moving or positioning the first braiding cord 501 relative to the others and/or the others relative to the first braiding cord 501).

Figure 6:
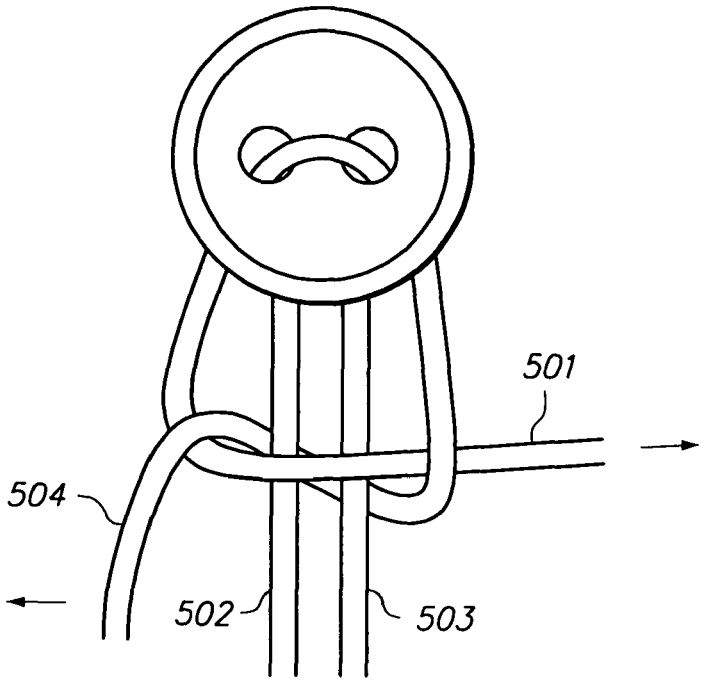

As shown in FIG. 6, the second braiding cord 504 is then bent into a reverse L shape such that the far right braiding cord 504 is positioned under both elastomeric cords 108 and up and through a first loop formed by the first braiding cord 501 and the first elastomeric cord 502. Once again, this step of arranging the second braiding cord 504 may be accomplished in various ways, including by moving or positioning that cord relative to the others and/or the others relative to the second braiding cord 504). The braiding cords 104 may then be pulled or extended outward, as in the direction of the arrows shown in FIG. 6. Pulling the braiding cords 104 generally tightens the knot being formed. It is contemplated that the braiding cords 104 may be pulled to the extent desired for structural or aesthetic reasons. For example, the braiding cords 104 may be pulled tighter to form tighter knots which better conceal the elastomeric cords 108 and create a stiffer decorative bracelet, if desired.

Figure 7:
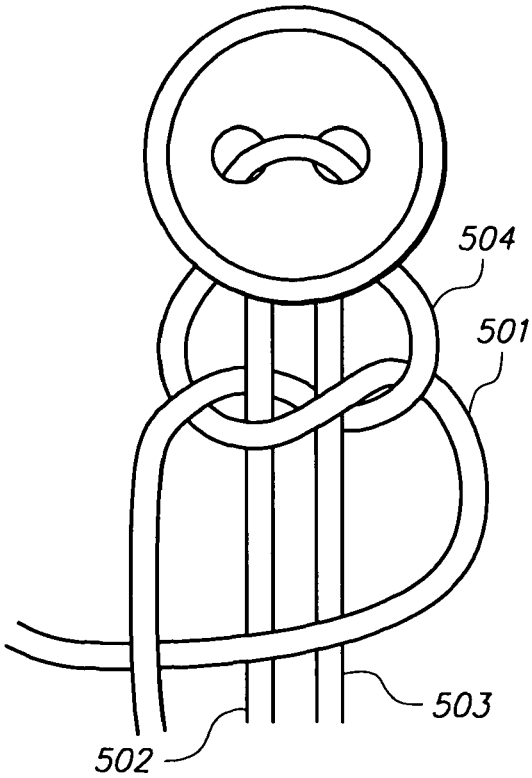
Figure 8:
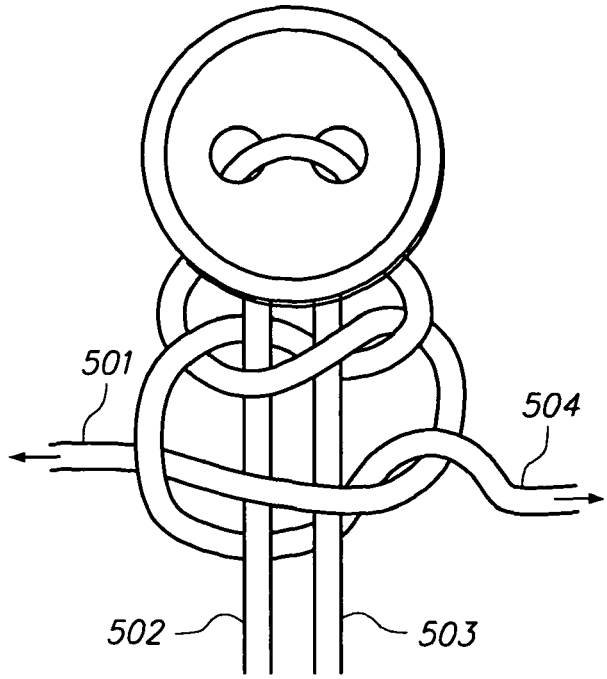
Figure 9:
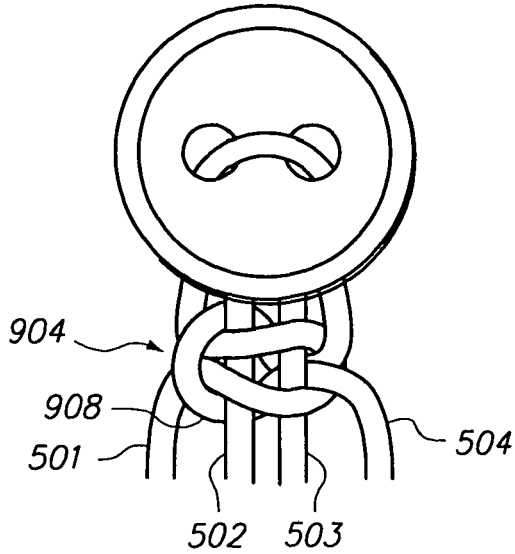
FIG. 9 illustrates an embodiment of a knot.

As illustrated in FIG. 7, the first braiding cord 501 is now the far right cord and the second braiding cord 504 is now the far left cord. The first braiding cord 501 is now bent into a reverse L shape such that it is over the elastomeric cords 108 and under the second braiding cord 504. Then, as shown in FIG. 8, the second braiding cord 504 is bent into an L shape (or otherwise positioned) such that it is under the elastomeric cords 108 and up and through a second loop formed by the second elastomeric cord 503 and the first braiding cord 501. The braiding cords 104 may then be pulled or extended outward, such as in the direction of the arrows of FIG. 8, to tighten and finish the knot. FIG. 9 shows a knot 904 made according to an embodiment of the invention.

Now, the first braiding cord 501 and the second braiding cord 504 should be the far left and far right cords, respectively. The first elastomeric cord 502 and the second elastomeric cord 503 should be in the middle, with the first elastomeric cord on the left. In this position, the cords are generally back to their original relative positions as illustrated in FIG. 5. It is noted that the cords may be positioned as they should be, at any time, if they currently are not. This can occur for example, when fabrication of the decorative bracelet has been temporarily stopped to be restarted later.

One or more additional knots may be made by repeating the method described above with respect to FIGS. 5-8. In addition, the method may be performed from right to left (i.e. flipped). For example, the second braiding cord 504 may be bent into a reverse L shape to begin the knot rather than bending the first braiding cord 501 into an L shape. Also, as shown in FIG. 9, a circular or moon shape 908 may be formed in the knot. The moon shape 908 may be used as an indicator of which side to start the next knot in one or more embodiments. It is contemplated that the decorative bracelet may not be comprised entirely of a single type of knot because other types of knots, weaves, or ties may be incorporated along the length of the bracelet.

In general, it will be appreciated that in this weaving or knotting process, the braiding cords 104 are generally woven around one another and the elastomeric cords 108. In particular, the elastomeric cords 108 generally comprise a linear base of the weave.

Figure 10A:
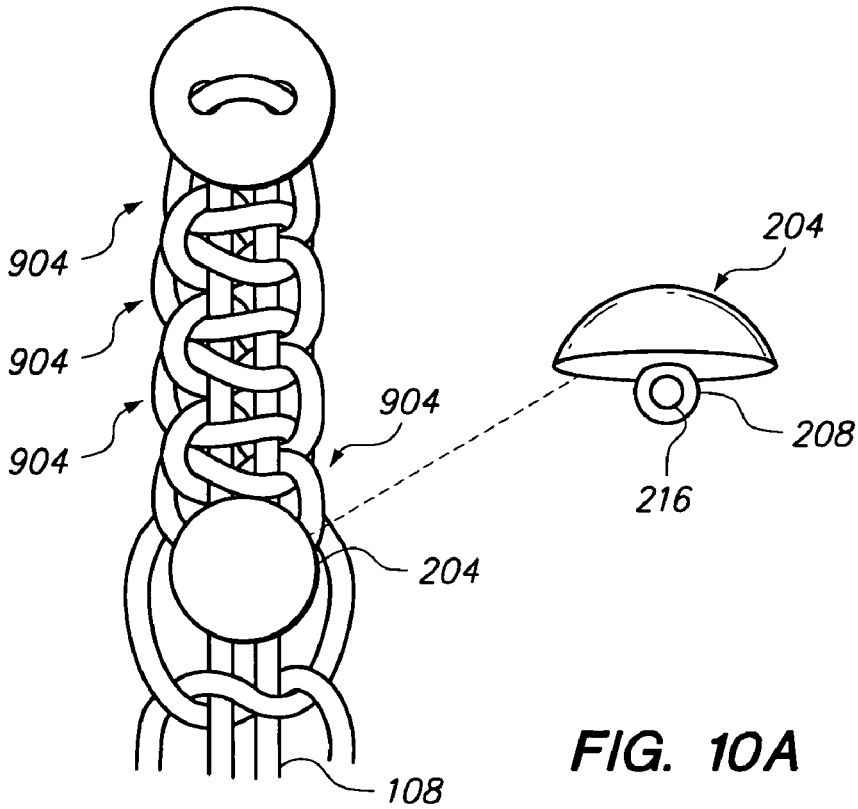
FIG. 10A illustrates a step of securing a decorative element according to an embodiment of the invention.

Once one or more knots 904 have been made, a button 204 or other decorative element may be added. FIG. 10A illustrates an embodiment where a button 204 with a shank 208 has been added to the decorative bracelet. A button 204 with a shank 208 may be threaded onto one or more of the elastomeric cords 108 and then slid or moved towards the one or more knots 904 until the button is against the one or more knots. An additional knot, such as the knot described above, may then be tied to secure the shank 208 and thus the button 204 in place. The knot may be tightened as much as possible to ensure the button 204 does not move.

Figure 10B:
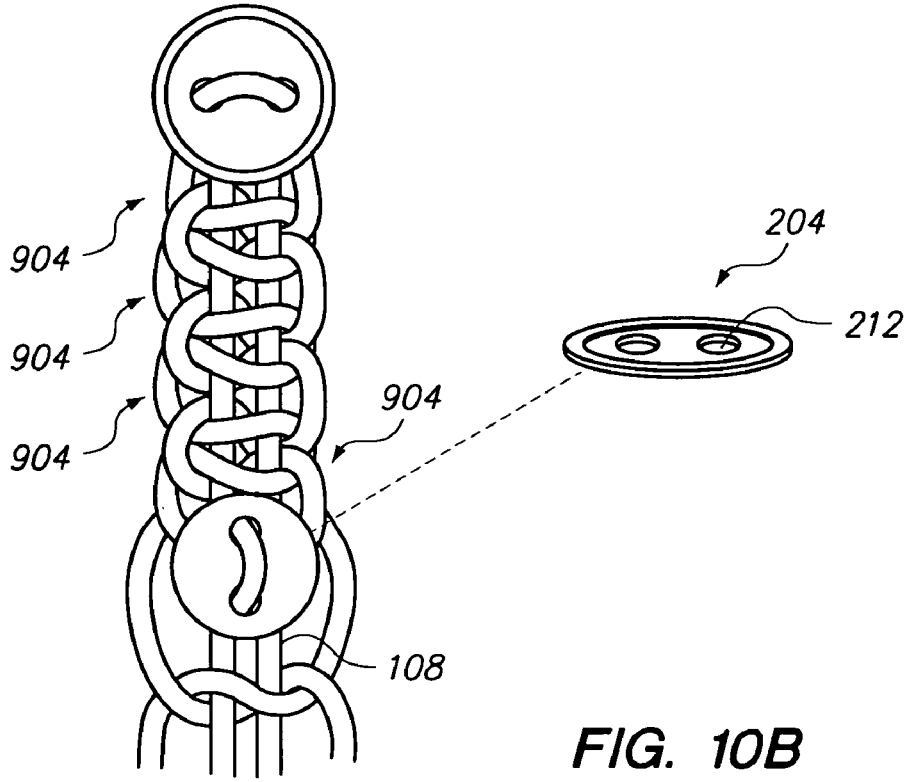
FIG. 10B illustrates a step of securing a decorative element according to another embodiment of the invention.

FIG. 10B illustrates an embodiment where a button 204 with holes 212 has been added to the decorative bracelet. One or more of the elastomeric cords 108 may be threaded through the holes 212 depending on the number of holes the button 204 has. As illustrated, the button 204 has two holes 212 and thus one of the elastomeric cords 108 may be threaded through both holes. A button with more holes 212 may allow additional elastomeric cords to be threaded there through. Of course, more than one elastomeric cord 108 may be threaded through the same hole 212.

Once the button 204 of this type has been threaded, the button may be slid towards the one or more knots 904 until the button is against the one or more knots. The button 204 may then be secured by another knot as described above. The elastomeric cords 108 may be pulled straight when this knot is being made to ensure the button 204 is properly secured. Not pulling the elastomeric cords 108 may affect how well a button 204 is secured. The knot may be tightened as desired, however, it is noted that over tightening with buttons 204 of this type may prevent the button from laying flat with the surface of the decorative bracelet. This may or may not be desirable for aesthetic or other reasons in one or more embodiments.

Here, further advantages of the elastomeric cords 108 can be seen. In one embodiment, a button is threaded onto the elastomeric cords 108, allowing the button to be secured to a decorative bracelet and displayed on its top surface. In traditional methods, decorative elements are embedded within the article, rather than being arranged at the outside or top of an article, because in traditional methods the decorative elements are secured to the article by weaving or knotting one or more cords around the decorative elements.

In addition, the elastomeric cords may have a wide variety of diameters and thus there are a substantially larger variety of decorative items that may be used with the invention herein. For example, large diameter elastomeric cords may be used to secure decorative elements having large holes or shanks such as large decorative elements for belts or suspenders. A small diameter elastomeric cord may be used to secure decorative elements having small holes or shanks such as small decorative elements for rings or earrings.

It is noted that because the elastomeric cords may be completely or substantially hidden in one or more embodiments of the invention herein, the diameter of the elastomeric cords may be independent of the braiding cords. Thus, for example, small decorative elements may be used in decorative bracelets with large braiding cords (e.g. braiding cords too large to be threaded through the desired decorative elements) because relatively smaller elastomeric cords may be used to secure these decorative elements. Traditional methods are incapable of this.

In addition, some decorative elements, such as the buttons having shanks described above or decorative elements with small holes, cannot be secured to an article using traditional methods. The invention herein allows these decorative elements to be secured while providing the advantage of displaying these decorative elements on the top surface of the decorative bracelet without surrounding knotting or weaving.

Not all decorative elements may be threaded on more than one elastomeric cord. For example, the hole or opening of the decorative element may be too small to accommodate more than one elastomeric cord. Thus, in some embodiments, the elastomeric cord that will align the decorative element relative to the decorative bracelet as desired may be selected before the decorative element is secured by a knot. In addition, in one or more embodiments, the elastomeric cords may be pulled to eliminate extra cord or slack behind or around the decorative element before the decorative element is secured.

Referring back to FIG. 1, a clasp 116 may be defined by a space between one or more knots and the exposed elastomeric cords 108 there between. For example, a clasp 116 may be formed after one or more knots, by skipping a distance and then tying one or more additional knots. The distance skipped will generally define the size of the clasp 116 and may be chosen according to the size of the one or more fasteners (or the decorative elements used as fasteners) to be used with the clasp (where the size of the clasp can be controlled by the distance between the knots). The knots of the clasp 116 may be formed according to the method described above with regard to FIGS. 5-8 or according to other knotting, weaving, or tying methods now known and later developed.

In one or more embodiments, the elastomeric cords 108 are generally more rigid than the braiding cords 104. Thus, a further advantage of the elastomeric cords 108 is that a clasp 116 formed with the elastomeric cords is better suited to accept and retain a fastener (since the cords may be stretched apart to define an opening through which the fastener may pass, the cords then contracting and tightening around the fastener to maintain it in place), than a clasp without elastomeric cords. In addition, the elastomeric cords 108 may be more resilient and durable thus increasing the reliability of the clasp 116 and the decorative bracelet 100.

Also referring to FIG. 1, a fuse bead 120 may be used at the second end 128 of the decorative bracelet 100 to secure the elastomeric cords 108 and the braiding cords 104. Securing the cords at the second end prevents the cords from unraveling and may be accomplished in various ways. In one embodiment, the elastomeric cords 108 and the braiding cords 104 may be inserted into the fuse bead 120 along with a quantity of adhesive to secure the cords within the fuse bead. The cords are secured as the adhesive sets. Of course, the cords may be secured at the second end by any method used to secure the cords at the first end, and vice versa. This includes but is not limited to tying, adhering, or melting the cords together or to a decorative element or other structure. In addition, various clips, crimping fasteners, or clamps may be used as well.

It will be appreciated that the length of the decorative article may vary. In particular numerous knots, clasps and/or decorative elements may be utilized in forming the article. In this manner, the total length of the article may vary.

In one embodiment, the decorative articles may be connected or combined. For example, a decorative element from one decorative article may be secured to a clasp of another article, thus joining or connecting them.

In one preferred embodiment, two portions of the same braided cord and two portions of the same elastomeric cord are utilized in the weaving process. However, entirely different cords could be utilized. For example, two separate braiding cords and two separate elastomeric cords could be utilized. Also, other numbers of cords (or portions thereof) might be utilized, as detailed above (for example, three, four or more elastomeric cords might be utilized).

As indicated, an advantage of the method and article of the invention is that a woven article is created which has as its base or core one or more elastomeric articles. This allows the article to be flexible, such as to stretch and contract. Though the elastomeric cords are inherently flexible, the braiding cords may move along or relative to the elastomeric cords. In addition, the knots formed by the braiding cords may tighten or loosen, thus allowing that portion of the article to stretch and contract as well. In this manner, as detailed, the article may stretch, such as to permit the article to be placed onto the wearer's body (over one's head, foot or hand, for example) and then contract to remain in place (such as on one's neck, ankle or wrist). Another advantage of the structure is that decorative articles can be supported by the elastomeric cords, thus allowing the braiding cords to form a purely decorative woven portion of the article.

It will be appreciated that the method of forming or weaving the decorative article of the invention may be accomplished manually, but might also be accomplished in whole or in part with one or more devices.

In one embodiment, the decorative article of the invention generally has two sides when formed, a top side and a bottom side. In one embodiment, the one or more decorative elements may be arranged to be located at the top side of the article (such as to be readily visible when the article is, for example, placed on a wearer's wrist). However, one or more of the decorative elements might be arranged to be at the outside of the bottom side of the article. This might be desirable, for example, if the article is to be used as artwork, such as where it might be hung and thus be visible from both sides.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A method of fabricating a decorative bracelet comprising:

securing a first elastomeric cord, a second elastomeric cord, a first braiding cord, and a second braiding cord to a first element, the first element forming a first end of a decorative bracelet;

once the first and second elastomeric cords and the first and second braiding cords are secured to the first element, forming one or more knots around the first and second elastomeric cords with the first and second braiding cords by:

positioning the first and second braiding cords and the first and second elastomeric cords such that the first braiding cord is at a far left position and the second braiding cord is at a far right position and the first elastomeric cord and the second elastomeric cord are therebetween with the first elastomeric cord to the left of the second elastomeric cord;

then, positioning the first braiding cord such that the first braiding cord is over the first elastomeric cord and the second elastomeric cord, and under the second braiding cord;

then, positioning the second braiding cord such that the second braiding cord is under the first elastomeric cord and the second elastomeric cord and up and through a first loop formed by the first braiding cord and the first elastomeric cord;

then, extending the first braiding cord and the second braiding cord outward;

then, positioning the first braiding cord at the far right position and the second braiding cord is at the far left position if the first braiding cord and the second braiding cord are not so positioned, and then bending the first braiding cord such that the first braiding cord is over the first elastomeric cord and the second elastomeric cord and under the second braiding cord;

then, positioning the second braiding cord such that the second braiding cord is under the first elastomeric cord and the second elastomeric cord and up and through a second loop formed by the first braiding cord and the second elastomeric cord; and then, extending the first braiding cord and the second braiding cord outward to complete one of the one or more knots;

threading one or more decorative elements onto at least the first elastomeric cord, wherein the one or more decorative elements are secured on the top surface of the decorative bracelet by at least the first elastomeric cords and at least two of the one or more knots; and after the one or more decorative elements are threaded onto the at least the first elastomeric cords, securing the first and second elastomeric cords and the first and second braiding cords at a second end of the decorative bracelet.

2. The method of claim 1 wherein the one or more decorative elements are one or more buttons, the one or more buttons having one or more shanks each with an opening, wherein threading the one or more decorative elements onto at least one of the first and second elastomeric cords comprises threading the at least one of the first and second elastomeric cords through the opening of the one or more shanks.

3. The method of claim 1 further comprising skipping a distance along the first and second elastomeric cords between at least two of the first and second knots to form a clasp.

4. The method of claim 1 wherein securing the first and second elastomeric cords and the first and second braiding cords at the first end of the decorative bracelet comprises threading the first and second elastomeric cords and the first and second braiding cords through at least one of the one or more decorative elements.

5. The method of claim 1 wherein securing the first and second elastomeric cords and the first and second braiding cords at the second end of the decorative bracelet comprises inserting the first and second elastomeric cords, the first and second braiding cords, and a quantity of adhesive into a fuse bead.

6. The method of claim 1 wherein the one or more decorative elements are one or more buttons, the one or more buttons having one or more holes, wherein threading the one or more decorative elements onto at least one of the first and second elastomeric cords comprises threading the at least one of the first and second elastomeric cords through the one or more holes.

7. The method of claim 1 wherein the first and second elastomeric cords are two distinct portions of a single elastomeric cord, and the first and second braiding cords are two distinct portions of a single braiding cord.

8. The method of claim 1 wherein the first and second elastomeric cords and the first and second braiding cords are formed from the same material.

* * * * *